US012643716B2

(12) United States Patent
Bohle

(10) Patent No.: US 12,643,716 B2
(45) Date of Patent: Jun. 2, 2026

(54) CONTAINER, CONTAINER CLOSURE AND REFILL CONTAINER

(71) Applicant: ALPLA Werke Alwin Lehner GmbH & Co. KG, Hard (AT)

(72) Inventor: Thomas Bohle, Alberschwende (AT)

(73) Assignee: ALPLA Werke Alwin Lehner GmbH & Co. KG, Hard (AT)

( * ) Notice: Subject to any disclaimer, the term of this patent is extended or adjusted under 35 U.S.C. 154(b) by 0 days.

(21) Appl. No.: 18/721,355

(22) PCT Filed: Dec. 14, 2022

(86) PCT No.: PCT/EP2022/085867
§ 371 (c)(1),
(2) Date: Jun. 18, 2024

(87) PCT Pub. No.: WO2023/117629
PCT Pub. Date: Jun. 29, 2023

(65) Prior Publication Data

US 2025/0033839 A1 Jan. 30, 2025

(30) Foreign Application Priority Data

Dec. 20, 2021 (CH) ..... 70747/2021

(51) Int. Cl.
*B65D 47/08* (2006.01)
*B65D 41/06* (2006.01)

(52) U.S. Cl.
CPC ..... *B65D 47/08* (2013.01); *B65D 41/06* (2013.01); *B65D 2547/066* (2013.01)

(58) Field of Classification Search
CPC ..... B05B 11/0056; B05B 11/0097; B65D 47/0838; B65D 47/08; B65D 47/121; B65D 47/125; B65D 47/126; B65D 51/243
See application file for complete search history.

(56) References Cited

U.S. PATENT DOCUMENTS

| | | | | |
|---|---|---|---|---|
| 2,646,704 | A * | 7/1953 | Reider | F23Q 2/52 81/3.09 |
| 3,059,816 | A * | 10/1962 | Goldstein | B65D 47/0842 222/545 |
| 5,971,231 | A | 10/1999 | Samz et al. | |
| 7,036,684 | B1 | 5/2006 | Hantman et al. | |
| 7,975,868 | B1 | 7/2011 | Flies et al. | |
| 2004/0094228 | A1 * | 5/2004 | Nadel | A63H 33/28 141/98 |
| 2021/0154697 | A1 * | 5/2021 | Bublewitz | B65D 55/02 |

FOREIGN PATENT DOCUMENTS

| | | | |
|---|---|---|---|
| GB | 2 342 347 | A | 4/2000 |
| WO | 93/21103 | A1 | 10/1993 |
| WO | 97/32791 | A1 | 9/1997 |
| WO | 2013/138490 | A1 | 9/2013 |

OTHER PUBLICATIONS

International Search Report corresponding to PCT/EP2022/085867 mailed Mar. 23, 2023.
Written Opinion corresponding to PCT/EP2022/085867 mailed Mar. 23, 2023.

* cited by examiner

*Primary Examiner* — Timothy P. Kelly
(74) *Attorney, Agent, or Firm* — Secant IP, PLLC

(57) ABSTRACT

The invention relates to a container closure (100) having a base body (20) for fastening to a container. A discharge opening (21) and a refill opening (22) are arranged in the base body (20). The refill opening (23) is closed by means of a plug (30).

15 Claims, 3 Drawing Sheets

CONTAINER, CONTAINER CLOSURE AND REFILL CONTAINER

Figure 1:
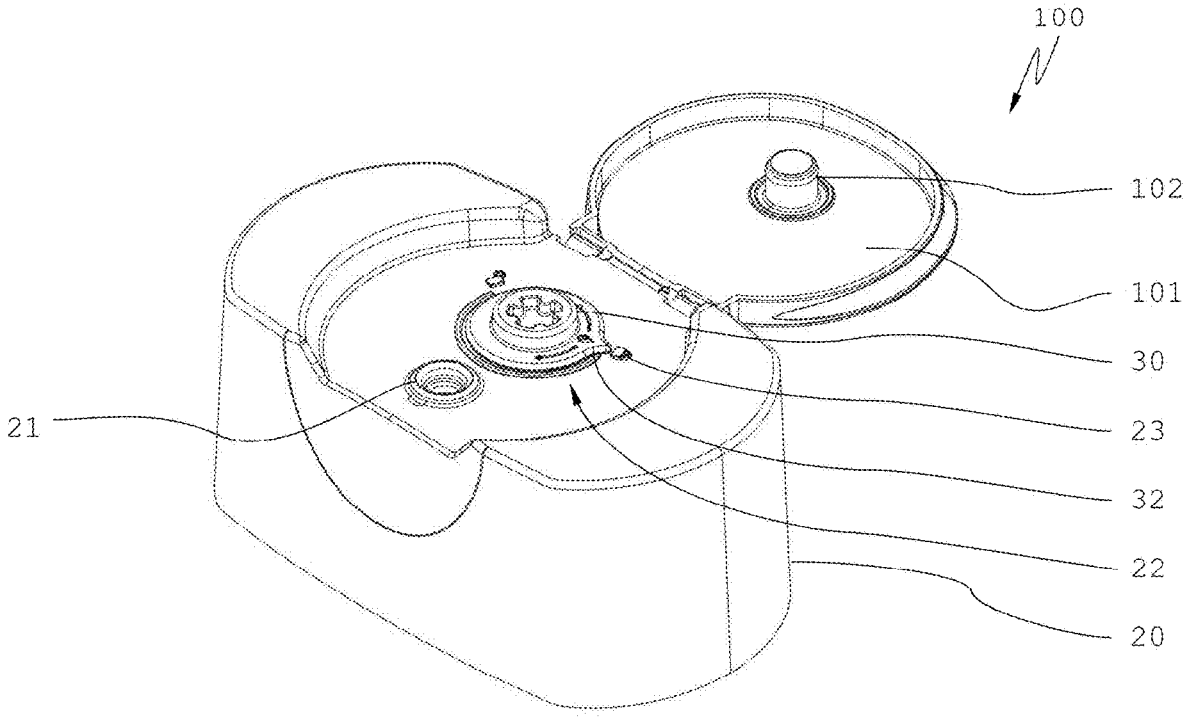

The present invention relates to a container closure, a container comprising a container closure, a refill container and a set consisting of a container having a container closure and a refill container in accordance with the preamble of the independent claims.

Various devices and methods for refilling bottles or containers are known from the prior art. On the one hand, this need arises from the fact that elaborately designed containers are to be used several times and refill bottles or refill containers for single use, for example, have to be less stable. There is also a need to design packaging materials in such a manner that resources are conserved. This also results, for example, in containers that are manufactured to be stable so that they can be used again and again in daily use and in refill containers that are made of relatively thin materials and are only intended for single use. For example, refill containers can be manufactured in the form of pouches.

GB 2 342 347 A, for example, discloses a refill container that has a special closure. This closure has a breakable wall which is broken open by screwing the refill container, together with the closure, onto the container to be refilled. This closure is expensive to manufacture, has a high material consumption and can only be used once. If, for example, not all the liquid can be dispensed from the refill container into the container to be refilled, the refill container can no longer be closed. Typically, such refill containers have a greater content than the container. The closure shown in GB 2 342 347 A connects the refill container with the container to be refilled. Due to the specific design of the closure, an emptying of the refilling container without residue is not possible.

Connecting nozzles, which are used to connect a refill container to the container to be refilled, are additionally known from the prior art. These are removed again after the process so that the containers can be resealed. After use, these connecting nozzles must either be disposed of or extensively cleaned so that they can be stored temporarily until the next use.

There are also containers, for example for products such as shower gels or shampoos, which have a container closure with only a small dispensing opening for dosing purposes. In order to obtain a sufficiently large opening for refilling, the container closure must be removed, which is typically very difficult with these containers.

There is also a need, in particular on the part of manufacturers, to only refill products that correspond to the original products.

It is therefore the object of the invention to remedy at least one or more disadvantages of the prior art. In particular, a container closure is to be provided that enables a container equipped therewith to be refilled easily and safely. In particular, a container closure is to be provided that simplifies refilling with an original product.

This object is achieved by the devices defined in the independent claims. Further embodiments result from the dependent claims.

A container closure according to the invention has a base body for fastening to a container. The base body has a discharge opening and a refill opening. The refill opening is closed with a plug.

This makes it possible to provide a container closure that has a relatively small opening as a dispensing opening or discharge opening for the dosed dispensing of a liquid, such as shampoo or shower gel. At the same time, the container has a correspondingly large refill opening through which the container can be refilled. By providing a refill opening in the container closure, it is possible to avoid removing the container closure from the container when refilling the container.

Closing the refill opening with a plug allows the container to be used regardless of its position, in particular when upside down, without the risk of the contents of the container being accidentally dispensed through the refill opening.

Preferably, the refill opening and the plug are detachably connected with corresponding fastening means, in particular with a thread or a bayonet closure.

The corresponding fastening means enable a guided connecting of the refill opening and the plug. In particular, such fastening means can be used to repeatedly set a relative position of the plug to the refill opening in exactly the same way. The relative position can therefore be reproduced again and again. It also favors a uniformly tight closure of the refill opening with the plug.

The plug can have a driving contour.

A driving contour allows the plug to be actuated, i.e. loosened or fastened.

Preferably, this driving contour is designed as a product-specific contour. The driving contour is coded in a particularly product-specific manner.

A product-specific design of the driving contour can prevent, at least to a certain extent, the plug from being used with a non-original, i.e. non-product, accessory. The use of original products can therefore be encouraged by the appropriate design of the driving contour.

The driving contour can, for example, have a polygonal cross-section and thus be designed as a triangle, a square or generally as an n-gon. In particular, it is also conceivable that there are recesses between the corners and that the contour correspondingly is designed in the shape of a star.

Preferably, the plug and the refill opening are in operative connection with one another via sealing surfaces.

It may be provided that a sealing surface is arranged on the plug. Additionally or alternatively, it can be provided that a sealing surface is arranged at the refill opening. It is conceivable that a seal is arranged on one of the two elements instead of a sealing surface. This seal can, for example, be designed as an integral part of the refill opening or the plug. It is also conceivable to use a separate sealing element such as a rubber seal, which can be designed in the form of an O-ring, for example.

The sealing surfaces and/or the corresponding seals ensure that the refill opening is tightly closed. By designing the sealing surface and/or the seals accordingly, a corresponding preload can be created in the connection when connecting the plug to the refill opening so that the plug is held securely in the refill opening.

Position marks can be arranged on the plug and/or the base body to indicate a closure status. It is conceivable that several position marks are arranged on the base body, which correspond to a further position mark on the plug depending on the closure state of the plug.

The user can thus visually check whether the container closure, in particular the refill opening, is securely closed with the plug.

The container closure can be designed as a flip-top closure.

The design as a flip-top closure allows easy handling of the container closure and, in particular, enables a closure plug to be captively arranged on the container closure to close the discharge opening.

The design as a flip-top closure also makes it possible to conceal the plug in such a manner that it is not visible on the product and therefore not accessible when the product is closed.

A further aspect relates to a refill container for refilling a container with a container closure arranged thereon, in particular a container with a container closure as described herein. The refill container has a filler neck and a closure lid. The filler neck is closed with the closure lid. A drive contour for releasing a plug is designed on the closure lid.

A refill container designed in such a manner with a drive contour on the closure lid makes it possible to open a plug that closes a refill opening on a container closure.

Preferably, this drive contour is designed as a product-specific contour. In particular, the drive contour corresponds to the driving contour on the plug. There is preferably exactly one pairing of drive contour and driving contour per product.

The drive contour can, for example, have a polygonal cross-section and thus be designed as a triangle, a square or generally as an n-gon. In particular, it is also conceivable that there are recesses between the corners and that the contour correspondingly is designed in the shape of a star.

A product-specific design of the drive contour can prevent, at least to a certain extent, the plug from being opened with a non-original, i.e. non-product, closure lid. The corresponding design of the drive contour, corresponding to the driving contour, can therefore encourage the use of original products.

Preferably, the filler neck and a refill opening of the container closure have corresponding fastening means, in particular a thread or a bayonet closure, for detachable connecting with one another.

The corresponding fastening means enable a guided connecting of the refill container to the refill opening. In particular, the refill container can be captively connected to the container, or to a container closure arranged on the container, by means of such fastening means. The discharge opening of the container closure allows air to be exchanged even when the refill container is firmly connected to the container closure. Excess air can escape. Connecting the filler neck to the refill opening prevents the liquid from leaking or spilling during the refilling process.

In particular, such fastening means can be used to repeatedly set a relative position of the filler neck to the refill opening in exactly the same way. The relative position can therefore be reproduced again and again. In addition, such fastening means can also be used to create a preload in the connection, which at least partially prevents the connection from opening accidentally.

The refill container can be designed as a bag.

Bags are relatively easy and cost-effective to produce and require relatively little material.

Alternatively, the refill container can be designed as an extrusion-blown container.

Extrusion-blown containers are also relatively cost-effective to produce. As these are typically blown out of a single-layer hose, it is easier to reuse them or return the residual materials to the material flow.

Another aspect relates to a container comprising a container closure as described herein. This makes it possible to provide a product in a container with an associated container closure that has a product-specific plug or a product-specific driving contour on the plug.

Another aspect relates to a set consisting of a container with a container closure, in particular with a container closure as described herein, and a refill container, in particular a refill container as described herein. The refill container has a closure lid and a plug is arranged on the container closure, which in particular closes a refill opening. The closure lid has a drive contour and the plug has a driving contour. The drive contour and the driving contour are designed to correspond to one another.

Such a set makes it possible to provide a product-specific combination of a container that can be refilled and an associated refill container.

Preferably, the container closure of the set has a refill opening that is closed with the plug. In this case, the refill container preferably has a filler neck that is closed with the closure lid. By providing a filler neck and a refill opening, the corresponding container can be easily refilled.

It may be provided that corresponding fastening means are arranged on the refill opening and on the filler neck, in particular a thread or a bayonet closure, for detachable connecting with one another.

The corresponding fastening means enable a guided connecting of the refill container to the refill opening. This ensures that only original products are used.

Figure 2:
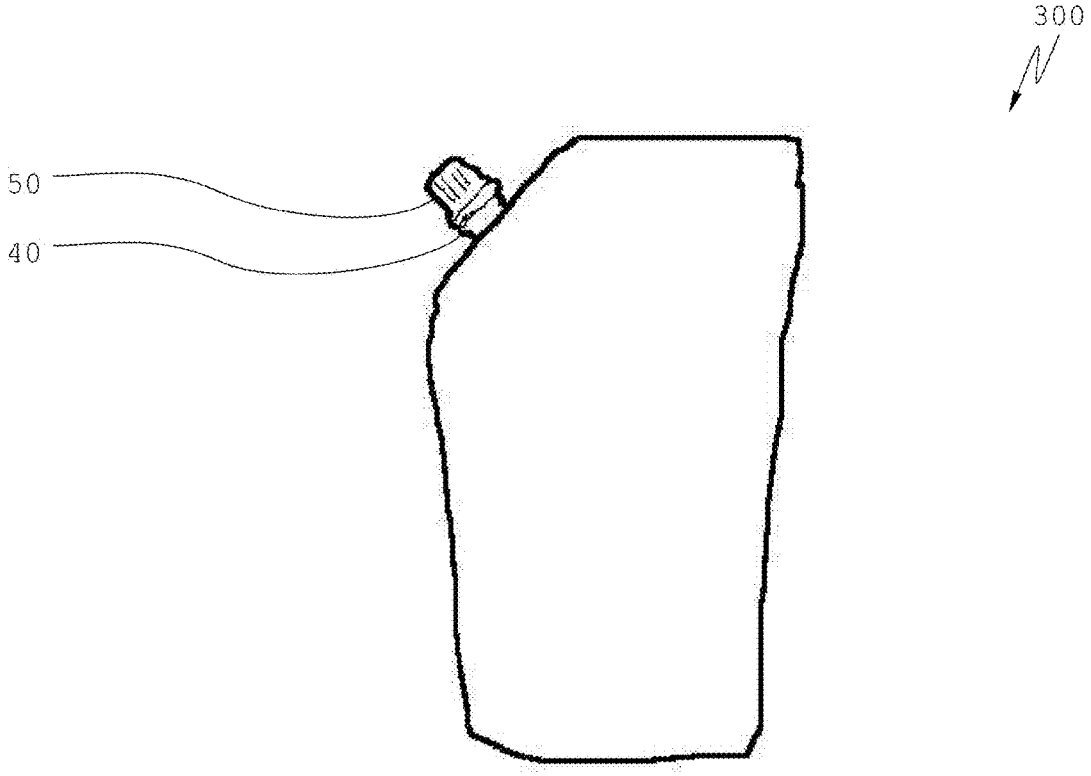
Figure 3:
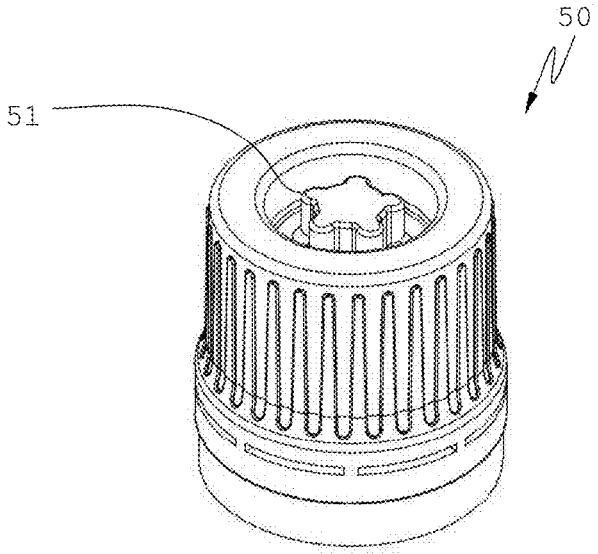
Figure 4:
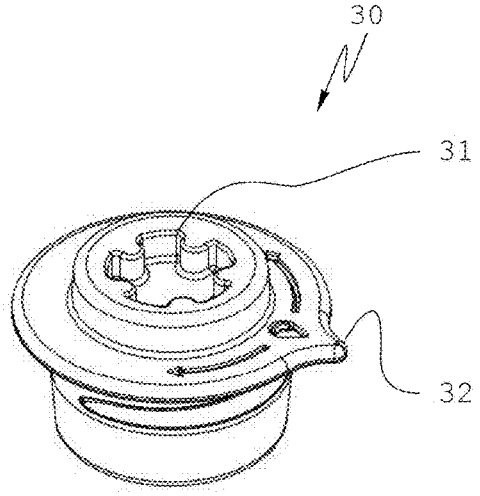
Figure 5:
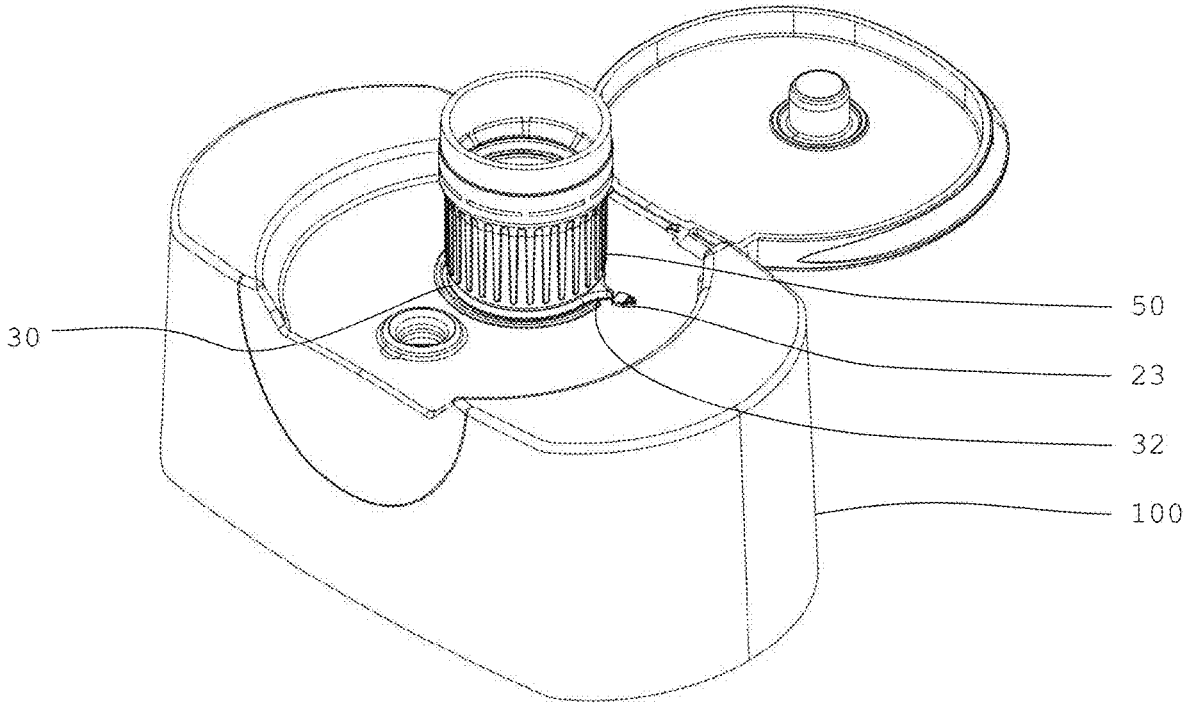
Figure 6:
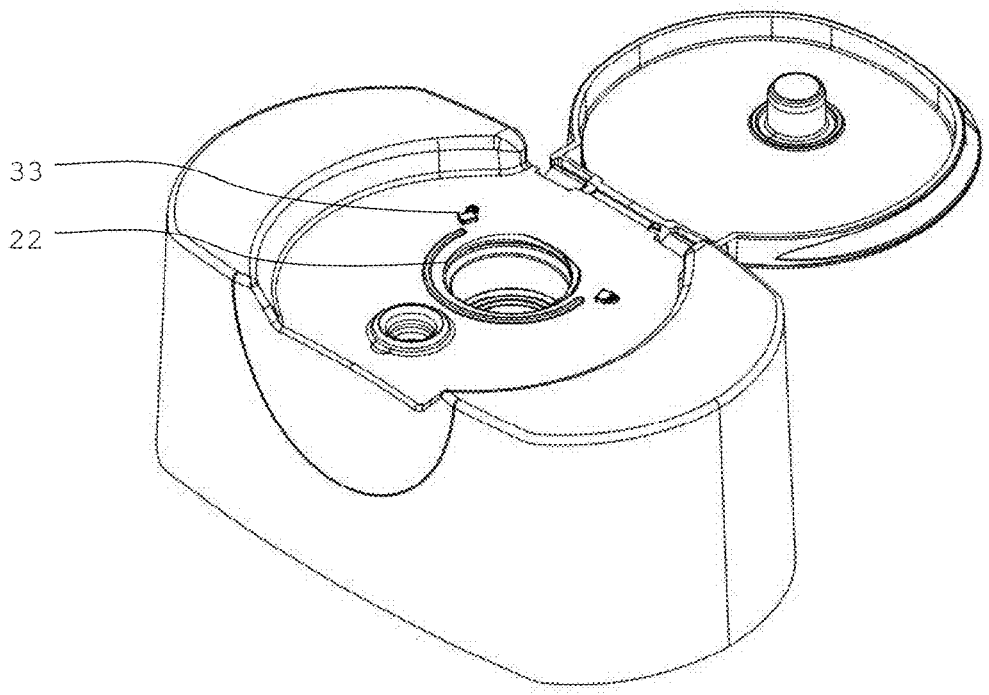
Figure 7:
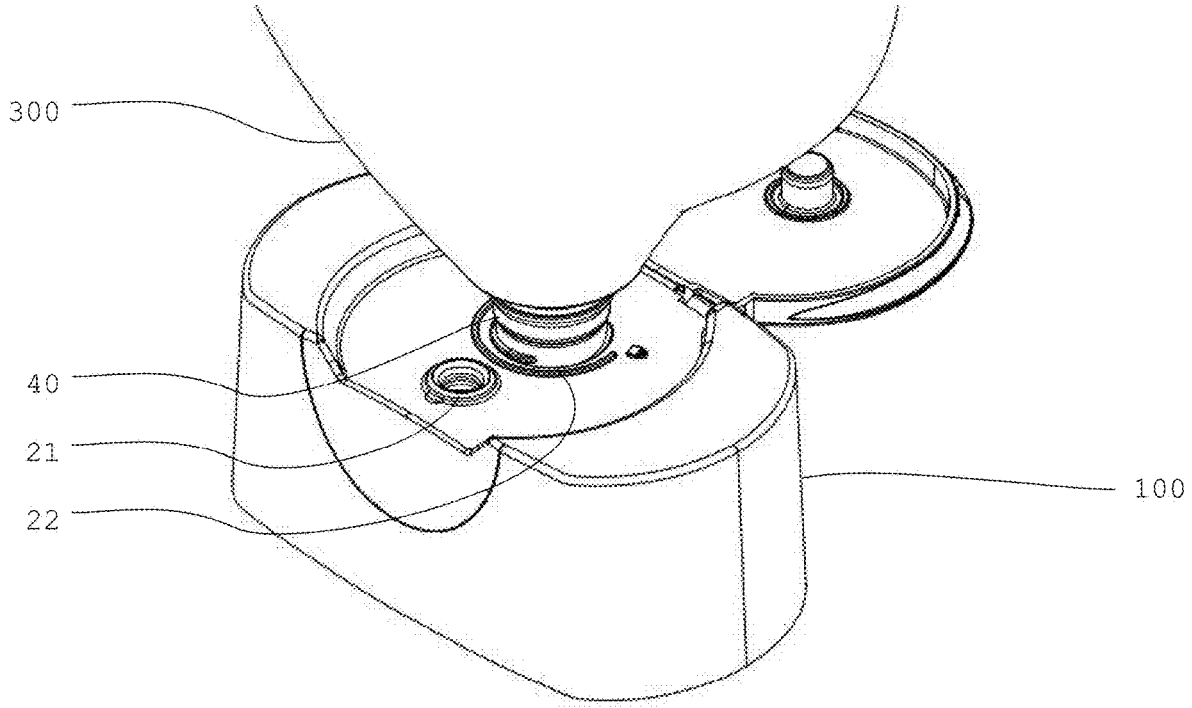

The invention is explained with reference to figures. In the figures:

FIG. 1: shows a perspective view of a container closure;

FIG. 2: shows a refill container;

FIG. 3: shows a closure lid;

FIG. 4: shows a plug;

FIG. 5: shows a container closure and a plug in engagement with one another;

FIG. 6: shows a container closure with the plug removed;

FIG. 7: shows a refill container in engagement with a refill opening on a container closure.

For the sake of clarity, a container on which the container closure is arranged is not shown in the figures.

FIG. 1 shows a perspective view of a container closure 100. The container closure 100 has a base body 20. A discharge opening 21 and a refill opening 22 are arranged in the base body 20. The refill opening 22 is closed with a plug 30. Two position marks 23 and 24 are arranged in the area of the refill opening 22, with which a corresponding position mark 32 of the plug 30 can be brought into alignment.

The container closure 100 is designed as a flip-top closure and has a flip-top lid 101 on which a closure plug 102 is arranged. The closure plug 102 closes the discharge opening 21 when the flip-top lid 101 is actuated. It also covers the plug 30.

FIG. 2 shows a refill container 300. Said refill container has a filler neck 40, which is closed with a closure 50. The refill container 300 is designed as a bag.

FIG. 3 shows a closure lid 50 in a perspective representation. The closure 50 has an unspecified structure on its periphery in order to be able to grip the closure 50 securely. At one end, the closure 50 has a recess in which a drive contour 51 is arranged. The drive contour 51 rises from the bottom of the recess as a positive protrusion. In the present case, the drive contour is designed with five radially extending protrusions and is therefore star-shaped.

FIG. 4 shows a plug 30 in a perspective representation. The plug 30 has an unspecified thread as a fastening means for fastening in the refill opening 22 (see FIG. 1 or 6). At one end, the plug has a recess as driving contour 31. In the present case, the driving contour 31 is designed to complement the drive contour 51 (see FIG. 3). In the present case, the drive contour is designed with five radially extending recesses. A position mark 32 is also arranged on the plug 30, which in the present case is designed as a radially extending protrusion.

FIG. 5 shows a container closure 100 and a plug 30 in engagement with one another. For this purpose, the drive contour 51 and the driving contour 31 are brought into engagement with one another. It can be seen that at this point in time, i.e. when the refill opening 22 is still closed, the position mark 32 and the position mark 23 are adjacent to one another. Typically, the closure 50 is unscrewed from the refill container 300 to create the state shown in FIG. 5.

FIG. 6 shows a container closure with the plug 30 removed. For this purpose, the closure 50 was rotated counterclockwise together with the plug 30 (FIG. 5) until the position mark 32 comes to lie adjacent to the position mark 33. The plug 30 can then be removed. As can be seen, the refill opening 22 is free.

FIG. 7 shows a refill container in engagement with a refill opening 22 on a container closure 100. A refill nozzle 40 is arranged on the refill container 300, which has fastening means corresponding to fastening means on the refill opening 22. In the present case, these are interlocking threads. This enables the secure connection of the refill container to the container on which the container closure 100 is arranged.

During the refilling process, the air can escape from the container through the discharge opening 21.

The thread on the filler neck is the same thread as that on the plug 30 (see FIG. 4). Accordingly, an internal thread on the closure 50 (see FIG. 3) is also designed in the same way as the thread of the refill opening.

The invention claimed is:

1. A container closure (100) with a base body (20) for fastening to a container, wherein a discharge opening (21) and a refill opening (22) are arranged in the base body (20), wherein the discharge opening is configured to discharge liquid from the container, and the refill opening (22) is closed with a plug (30), and the refill opening (22) and the plug (30) are detachably connected to each other by corresponding fastening means.

2. The container closure (100) according to claim 1, wherein the corresponding fastening means is a thread or a bayonet closure.

3. The container closure (100) according to claim 1, wherein the plug (30) has a driving contour (31).

4. The container closure (100) according to claim 3, wherein the driving contour (31) is designed as a product-specific contour.

5. The container closure (100) according to claim 1, wherein the plug (30) and the refill opening (22) are operatively connected to one another via sealing surfaces.

6. The container closure (100) according to claim 1, wherein position marks (23, 32, 33) are arranged on the plug (30) and/or on the base body (20) to indicate a closure state.

7. The container closure (100) according to claim 1, wherein the container closure (100) is designed as a flip-top closure.

8. A container, comprising a container closure (100) according to claim 1.

9. A set, consisting of a container with a closure (100) according to claim 1, and a refill container (300) with a closure lid (50), wherein a plug (30) is arranged on the container closure (100), wherein the closure lid (50) has a drive contour (51) and the plug (30) has a driving contour (31), wherein the drive contour (51) and the driving contour (31) are designed to correspond to one another.

10. The set according to claim 9, wherein the container closure (100) has a refill opening (22) which is closed by the plug (30), and the refill container (300) has a filler neck (40) which is closed by the closure lid (50).

11. The set according to claim 10, wherein fastening means are arranged on the refill opening (22) and on the filler neck (40).

12. The set according to claim 11, wherein the fastening means is a thread or a bayonet closure.

13. A set, consisting of a container with a container closure (100) with a base body (20) for fastening to the container, wherein a discharge opening (21) and a refill opening (22) are arranged in the base body (20), wherein the refill opening (23) is closed with a plug (30), a refill container (300) with a closure lid (50), wherein the closure lid (50) has a drive contour (51) and the plug (30) has a driving contour (31), wherein the drive contour (51) and the driving contour (31) are designed to correspond to each other, the container closure (100) has the refill opening (22) which is closed by the plug (30), and the refill container (300) has a filler neck (40) which is closed by the closure lid (50)

wherein fastening means are arranged on the refill opening (22) and on the filler neck (40) for detachable connecting to each other.

14. The container closure (100) according to claim 7, wherein the flip-top closure has a first plug that is received within and closes the discharge opening (21) when the flip-top closure is closed.

15. The container closure (100) according to claim 1, wherein the plug (30) that closes the refill opening (23) is independent of the container closure (100).

* * * * *